US009770729B2

(12) United States Patent
Yuan et al.

(10) Patent No.: US 9,770,729 B2
(45) Date of Patent: Sep. 26, 2017

(54) DOUBLE-NOZZLE INJECTOR CAPABLE OF SPRAYING EVENLY AT MEDIUM AND LOW PRESSURE

(71) Applicant: JIANGSU UNIVERSITY, Jiangsu (CN)

(72) Inventors: Shouqi Yuan, Jiangsu (CN); Xingye Zhu, Jiangsu (CN); Hong Li, Jiangsu (CN); Junping Liu, Jiangsu (CN)

(73) Assignee: JIANGSU UNIVERSITY, Jiangsu (CN)

( * ) Notice: Subject to any disclaimer, the term of this patent is extended or adjusted under 35 U.S.C. 154(b) by 124 days.

(21) Appl. No.: 14/889,609

(22) PCT Filed: May 21, 2013

(86) PCT No.: PCT/CN2013/075983

§ 371 (c)(1),
(2) Date: Nov. 6, 2015

(87) PCT Pub. No.: WO2014/180007

PCT Pub. Date: Nov. 13, 2014

(65) Prior Publication Data

US 2016/0082451 A1 Mar. 24, 2016

(30) Foreign Application Priority Data

May 8, 2013 (CN) ..... 2013 1 0165250

(51) Int. Cl.
*B05B 15/00* (2006.01)
*B05B 7/08* (2006.01)
(Continued)

(52) U.S. Cl.
CPC ..... *B05B 7/08* (2013.01); *B05B 1/02* (2013.01); *B05B 3/06* (2013.01); *B05B 12/087* (2013.01);
(Continued)

(58) Field of Classification Search
CPC ... B05B 15/0406; B05B 15/0425; B05B 7/08; B05B 1/02; B05B 3/06; B05B 12/087; B05B 7/2491
(Continued)

(56) References Cited

U.S. PATENT DOCUMENTS 2,707,021 A * 4/1955 Harris ..... F02C 7/22 137/110
3,929,291 A * 12/1975 Ladisch ..... B05B 7/061 239/425
(Continued)

FOREIGN PATENT DOCUMENTS

CN 2060370 U 8/1990
CN 2323879 Y 6/1999
(Continued)

OTHER PUBLICATIONS

International Search Report for PCT/CN2013/075983 dated Feb. 20, 2014.

*Primary Examiner* — Alexander Valvis
(74) *Attorney, Agent, or Firm* — Heslin Rothenberg Farley & Mesiti, P.C.

(57) ABSTRACT

An injecting body of the injector is provided with two outlets. One outlet is connected to an auxiliary nozzle in a threaded manner, and the other outlet is connected to an injecting element body in a threaded manner. The water taking signal nozzle circularly takes signal water and air conveniently and reliably, so that a low-pressure vortex region is discontinuously formed at one side of the injecting element body; formation and disappearance of a pressure difference between a left cavity and a right cavity can be implemented in an automatic control manner, and wall attachment of water and rotation of the injector are implemented. The auxiliary nozzle is primarily used for supplementing near water distribution of the double-nozzle injector capable of spraying at a medium and low pressure, so as to improve spraying evenness.

8 Claims, 3 Drawing Sheets

(51) Int. Cl.

| | |
|---|---|
| ***B05B 15/04*** | (2006.01) |
| ***B05B 3/06*** | (2006.01) |
| ***B05B 12/08*** | (2006.01) |
| ***B05B 1/02*** | (2006.01) |

(52) U.S. Cl.
CPC ..... *B05B 15/0406* (2013.01); *B05B 15/0425* (2013.01)

(58) Field of Classification Search
USPC .... 239/124, 125, 225.1, 246–249, 289, 565; 222/109, 318, 424
See application file for complete search history.

(56) References Cited

U.S. PATENT DOCUMENTS

| | | | | |
|---|---|---|---|---|
| 4,018,386 | A | 4/1977 | Barichello | |
| 6,488,216 | B1 * | 12/2002 | Lewis ..... | B05B 7/2478 134/102.1 |

FOREIGN PATENT DOCUMENTS

| | | | |
|---|---|---|---|
| CN | 2367397 | Y | 3/2000 |
| CN | 2003222424.9 | U | 6/2003 |
| CN | 200710134562.5 | | 10/2007 |
| CN | 200810019601.1 | | 3/2008 |
| CN | 101972722 | A | 2/2011 |

* cited by examiner

DOUBLE-NOZZLE INJECTOR CAPABLE OF SPRAYING EVENLY AT MEDIUM AND LOW PRESSURE

CROSS REFERENCE TO RELATED APPLICATIONS

This application is a national stage filing under section 371 of International Application No. PCT/CN2013/075983, filed on May 21, 2013, and published in Chinese on Nov. 13, 2014, as WO 2014/180007 A1, which claims priority of Chinese Patent Application No. 201310165250.6 filed on May 8, 2013, the entire content of said applications being hereby incorporated herein by reference.

TECHNICAL FIELD

The present invention belongs to the key equipment of water-saving sprinkling irrigation system and is suitable for solving the problems that a fluidic sprinkler cannot work stably under a medium and low pressure condition and has poor evenness. In particular, the present invention relates to a medium and low-pressure evenly sprinkling fluidic sprinkler with double nozzles.

BACKGROUND

The performance of sprinklers impacts the effect of sprinkling irrigation directly. The fluidic sprinkler is the key equipment in the sprinkling irrigation system and has certain application prospects. The existing fluidic sprinkler is in a structural form of single nozzle, and has a key technical problem that the sprinkler cannot accomplish stable rotation caused by insufficient driving force due to insufficient obtained under a medium and low working pressure, and the sprinkling of a single nozzle further has a problem of poor evenness under a medium and low working pressure. Therefore, it is of important significance to develop a fluidic sprinkler with double nozzles capable of spraying evenly under medium and low pressure.

By retrieval, the existing related patent applications are as follows: COMPLETE FLUIDIC SPRINKLER (Application No.: 03222424.9); VARIABLE SPRINKLING COMPLETE FLUIDIC SPRINKLER (Application No.: 200810019601.1); and ATTACHMENT FLUIDIC SPRINKLER (Application No.: 200710134562.5), all of the above are fluidic sprinklers with a single nozzle having problems that the sprinklers cannot work stably and have poor evenness under a medium and low pressure. ROTARY SPRINKLER WITH DOUBLE NOZZLES (Application No.: 862063124), which is directed to a rotary high pressure water-jet sprinkler with double nozzles. The application (Application Number: 201010552792.5), which is entitled AN ATTACHMENT EXTERNAL WATER-INTAKE JET CONTROL ELEMENT, has a structure including an external water-intake signal nozzle, an outlet cover plate, a gasket, a conduit and an entry pore. The stable work of the attachment external water-intake jet control element can be affected by various factors including setting of outlet diameter of the cover plate, selection of the position of the entry pore, adjustment of the water-intake position of the signal nozzle and the like, and it is easy to neglect the importance for adjusting the water-intake position of the signal nozzle. This application has the shortage that the water-intake signal nozzle is fixedly located above the outlet of the gasket, such that under a medium and low pressure, the water-intake signal nozzle cannot be adjusted to obtain signal water, and thus the sprinkler cannot accomplish rotation. The application (Application Number: 2060370U), which is entitled A DOUBLE-STROKE SYNCHRONIZATION COMPLETE FLUIDIC SPRINKLER, has a structure including a secondary nozzle, a sprinkler body, a fluidic element body and a cover plate. This application has the shortage that the shape, size, setting position of the cover plate are not defined, and under a medium and low pressure condition, it cannot be guaranteed that the fluidic sprinkler stably and reliably obtains the signal water and accomplishes rotation. The above patents do not report a fluidic sprinkler with double nozzles which realizes evenly sprinkling under a medium and low pressure.

SUMMARY OF THE INVENTION

The present invention aims to provide a fluidic sprinkler with double nozzles capable of spraying evenly at medium and low pressure with a simple structure, reliable operation and stable work. The fluidic sprinkler works stably under a medium and low pressure and realizes evenly sprinkling.

The invention belongs to the key equipment of water-saving sprinkling irrigation system. The fluidic sprinkler with double nozzles capable of spraying evenly at medium and low pressure includes a secondary nozzle, a sprinkler body, a fluidic element body, a cover plate, a water-intake signal nozzle, a bolt, a joint, a screw, a conduit and an water-entry collecting tubule. Two outlets are formed on the sprinkler body in a Y shape. One outlet of the sprinkler body is in threaded connection with the secondary nozzle, and the other outlet is in threaded connection with the fluidic element body. The cover plate is fixedly installed at an end of the fluidic element body, and the inner diameter of the cover plate is greater than the outer diameter of the fluidic element body. An installing hole is formed on one side of the cover plate, and the central axis of the installing hole is parallel to that of the fluidic element body. A circular through hole and a threaded through hole are formed on the joint with their axes vertical to each other. The inner diameter of the circular through hole is greater than the outer diameter of the water-intake signal nozzle. One end of the screw is in threaded connection with the installing hole on one side of the cover plate, and the other end is in threaded connection with the threaded through hole of the joint. The axial setting position of the water-intake signal nozzle is fixed through the screw. The water-intake signal nozzle passes through the circular through hole of the joint. The bolt is in threaded fitting with the threaded through hole in the joint. The setting position of the water-intake signal nozzle is fixed through the bolt, such that the water-intake signal nozzle is fixedly located above the outlet of the cover plate. The water-intake signal nozzle is connected with the water-entry collecting tubule on the sidewall of the fluidic element body through the conduit.

The elevation angles of two outlets of the sprinkler body are a fluidic element body elevation angle and a secondary nozzle elevation angle respectively, and the fluidic element body elevation angle is 1 to 1.5 times the secondary nozzle elevation angle.

The secondary nozzle is provided with a secondary locknut which adjusts the setting position of the outlet of the secondary nozzle such that the secondary nozzle supplements near water distribution of the medium and low-pressure evenly sprinkling fluidic sprinkler with double nozzles and improves its sprinkling evenness.

The fluidic element body is provided with a primary locknut which adjusts the setting position of the fluidic element body such that the fluidic element body obtains a driving force to drive the medium and low-pressure evenly sprinkling fluidic sprinkler with double nozzles to accomplish rotation.

A middle locknut and a lower locknut are arranged on the screw on two sides of the cover plate, respectively, for fixing the connection position between the screw and the cover plate.

The outlet diameter of the cover plate is 1.2 to 1.8 times the diameter of the basic circular hole.

An upper locknut is arranged on the screw near the threaded through hole of the joint, for fixing the connection position between the screw and the joint.

A water intake of the water-intake signal nozzle is in a wedge shape with one end of a sharp-crested shape, the other end of a circular shape and a middle part of linear transition. The end face of the water-intake signal nozzle and the axis of the water-intake signal nozzle form an included angle of less than 90°; and the axes of the water-intake signal nozzle as well as the water-entry collecting tubule of the fluidic element body and an air supply hole are in the same cross section along the central axis.

In principal, the differences between the present invention and the control element of the existing fluidic sprinkler are as follows: the existing disclosed fluidic sprinkler cannot stably obtain the signal water and cannot efficiently control formation and elimination of pressure difference between the left and right chambers to accomplish rotation of the sprinkler under a working condition with a medium and low pressure. In the present invention, the water-intake signal nozzle is arranged at the outlet of the fluidic element body. The water-intake signal nozzle circularly obtains signal water and air conveniently and reliably under a working condition with a medium and low pressure, such that a low pressure vortex zone is discontinuously formed on one side of the main fluidics, and thus it is self-controlled to accomplish formation and elimination of the pressure difference between the left and right chambers, to realize wall attachment of a water flow and rotation of the sprinkler.

The advantages of the present invention are: simple structure, reliable operation, and stable work and avoid the shortages of unstable rotation and poor sprinkling evenness of existing fluidic sprinkler under a medium and low pressure.

In the figures, 1. secondary nozzle; 2. secondary locknut; 3. secondary nozzle elevation angle; 4. sprinkler body; 5. air supply hole; 6. fluidic element body; 7. primary locknut; 8. fluidic element body elevation angle; 9. cover plate; 10. water-intake signal nozzle; 11. bolt; 12. joint; 13. upper locknut; 14. screw; 15. middle locknut; 16. lower locknut; 17. conduit; 18. active region; 19. water-entry collecting tubule; 20. basic circular hole; 21. cover plate inner diameter; 22. installing hole; 23. circular through hole; 24. threaded through hole.

DETAILED DESCRIPTION

Figure 1:
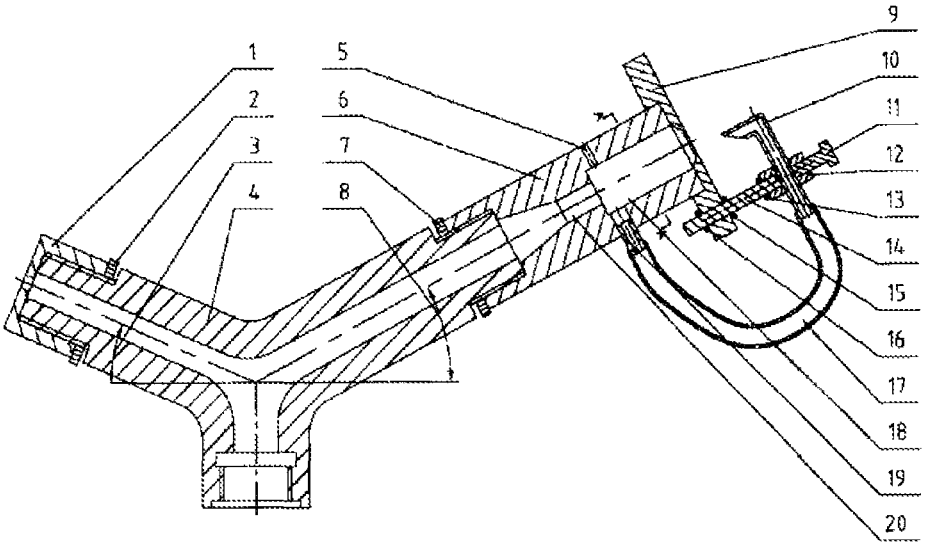
FIG. 1 is a schematic diagram of a fluidic sprinkler with double nozzles capable of spraying evenly at medium and low pressure.
Figure 2:
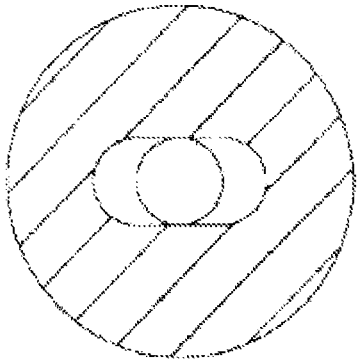
FIG. 2 is an A-A sectional view of FIG. 1.
Figure 3:
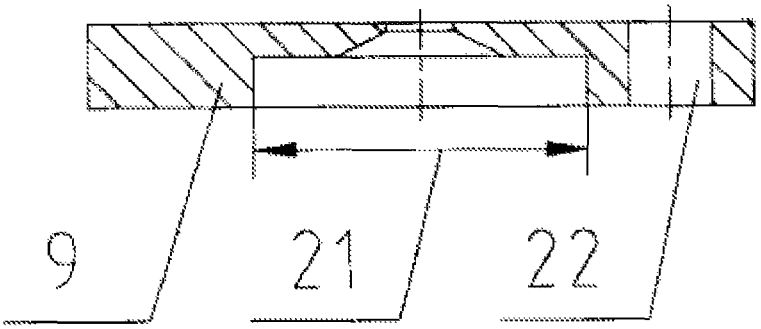
FIG. 3 is a schematic diagram of a cover plate.
Figure 4:
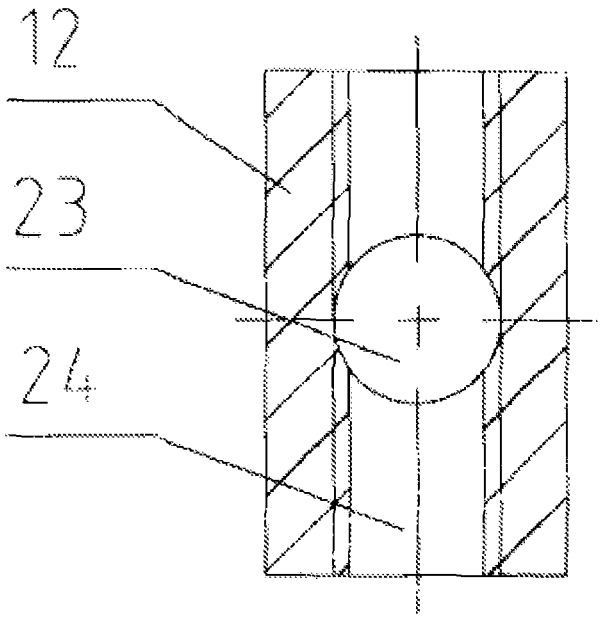
FIG. 4 is a schematic diagram of a joint.
Figure 5:
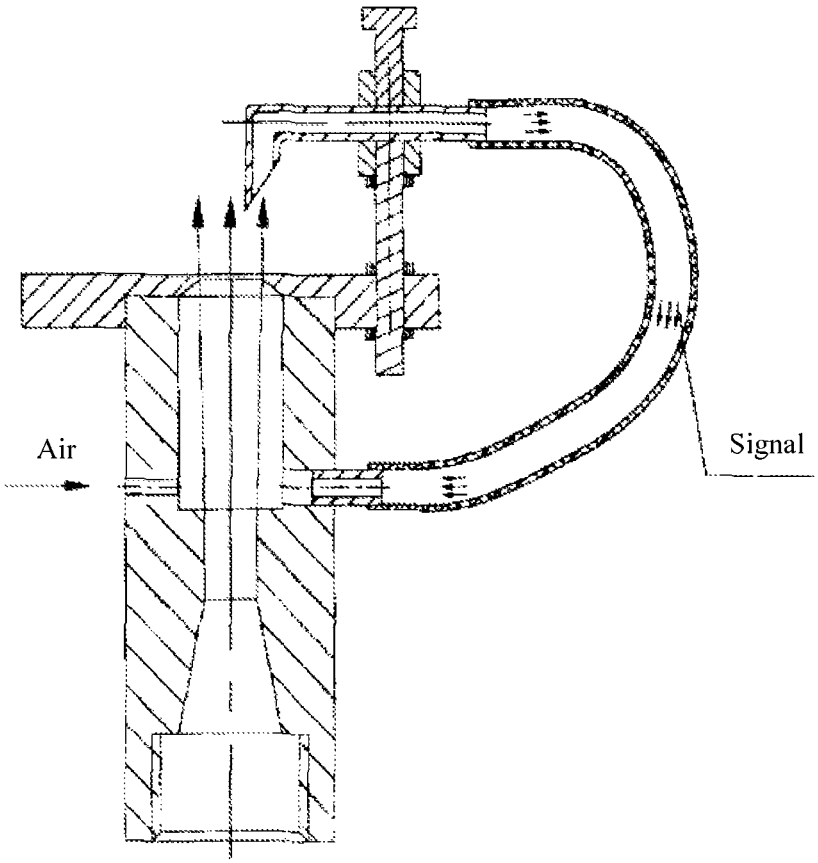
FIG. 5 is a schematic diagram of a direct jetting state of the present invention.
Figure 6:
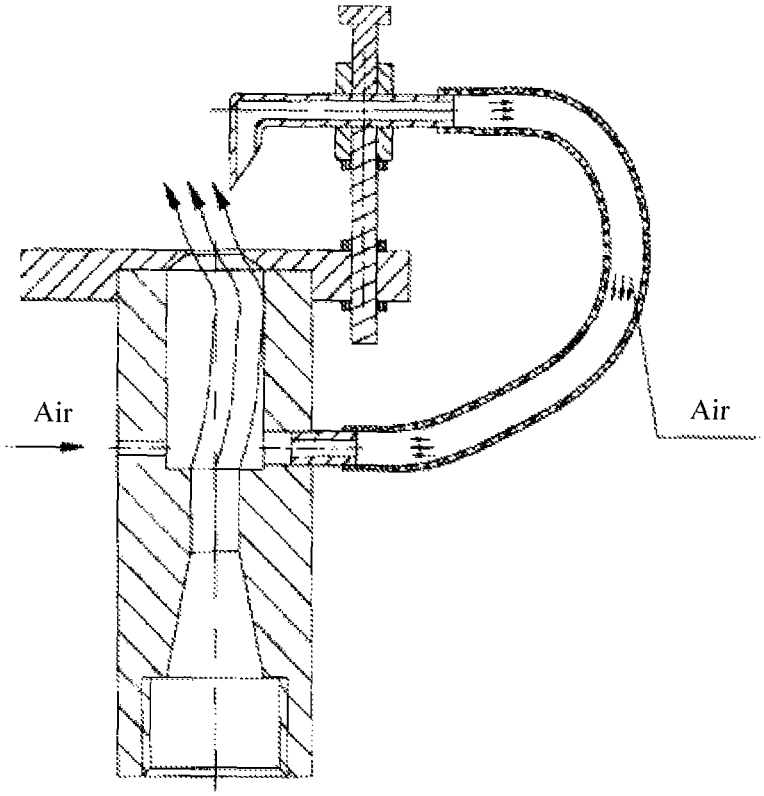
FIG. 6 is a schematic diagram of a wall attachment state of the present invention.

As shown in FIG. 1, the present invention includes a secondary nozzle 1, a secondary locknut 2, a sprinkler body 4, a fluidic element body 6, a primary locknut 7, a cover plate 9, a water-intake signal nozzle 10, a bolt 11, a joint 12, an upper locknut 13, a screw 14, a middle locknut 15, a lower locknut 16, a conduit 17, and an water-entry collecting tubule 19. Among the above, the secondary nozzle 1 is in threaded connection with the sprinkler body 4. The secondary locknut 2 is used for fixing the connection position between the secondary nozzle 1 and the sprinkler body 4. The screw is used for fixedly installing the cover plate 9 on the upper end of the fluidic element body 6. The fluidic element body 6 is in threaded connection with the sprinkler body 4. The primary locknut 7 is used for fixing the connection position between the fluidic element body 6 and the sprinkler body 4. One end of the screw 14 is in threaded connection with the joint 12. The upper locknut 13 is used for fixing the connection position between the screw 14 and the joint 12. The other end of the screw 14 is in threaded connection with the installing hole 22 of the cover plate 9. The middle locknut 15 is used for fixing the connection position between the screw 14 and the cover plate 9. The lower locknut 16 is used for fixing the connection position between the screw 14 and the cover plate 9. The water-intake signal nozzle 10 is arranged inside the circular through hole 23 of the joint 12. The water-intake signal nozzle 10, the water-entry collecting tubule 19, and the air supply hole 5 are located at the same cross section position along the central axis. The bolt 11 is used for fixing the setting position of the water-intake signal nozzle 10. When the sprinkler works under a medium and low pressure condition, the lower locknut 16 is loosened, the middle locknut 15 is loosened, the screw 14 is adjusted to direct the water-intake signal nozzle 10 to the axial setting position, and the middle locknut 15 and the lower locknut 16 are locked to fix the connection position between the screw 14 and the cover plate 9. The upper locknut 13 is loosened, the central line of the circular through hole 23 in the joint 12 is adjusted to be parallel to that of the entry tap 19, and the upper locknut 13 is locked to fix the connection position between the screw 14 and joint 12. The bolt 11 is loosened, the water-intake signal nozzle 10 is adjusted to the radial setting position, and the bolt 11 is locked to fix the water-intake signal nozzle 10, such that the water-intake signal nozzle 10 obtains more signal water, the fluidic element body 6 obtains a sufficient driving force to drive the medium and low-pressure evenly sprinkling fluidic sprinkler with double nozzles to accomplish rotation.

The inlet of the sprinkler body 4 is connected with the central shaft of the fluidic sprinkler. Two outlets are formed on the sprinkler body 4, one of which is connected with the secondary nozzle 1 and the other is connected with the fluidic element body 6. When the fluidic element body 6 obtains a driving force, the sprinkler body 4 accomplishes rotation as the central shaft of the fluidic sprinkler rotates. The fluidic element body 6 accomplishes rotation of the sprinkler in two states, i.e., direct jetting and wall attachment. The working process is as follows:

Direct jetting state: the water flow is jetted into the active region 18 through the basic circular hole 20, and discharged from the outlet of the cover plate 9. Low pressure vortex zones are formed on the left and right ends of the active region 18. The left side of the fluidic element body 6 is supplied with air by the air supply hole 5, and the right side is supplied with air by the water-intake signal nozzle 10, and when both sides have equal pressure, the water flow is jetted directly and the sprinkler is stationary. At this time, the water-intake signal nozzle 10 obtains signal water at the outlet of the cover plate 9, and the obtained signal water flows in the conduit 17 toward the water-entry collecting tubule 19.

Wall attachment state: the signal water obtained by the water-intake signal nozzle 10 flows to the water-entry collecting tubule 19, such that the right side is supplied with no air, causes the right side to form a low pressure vortex zone, and the left side has a pressure greater than that of the right side, the main fluidics attaches wall toward the right side, and the water flow enables the fluidic element body 6 to obtain a driving force through a chamfer of the cover plate 9, and the sprinkler body 4 accomplishes rotation. At this time, since the water flow attaches wall toward the right side in the active region 18, the water flow is deviated to the left side through the chamfer of the cover plate 9 at the outlet, and the water-intake signal nozzle 10 is discharged and obtains no signal water but air. After the signal water in the conduit 17 is exhausted, air enters into the water-entry collecting tubule 19, two sides have the same pressure, and the main fluidics return to the direct jetting state and so forth. The sprinkler is self-controlled to accomplish all round rotation.

The invention claimed is:

1. A fluidic sprinkler with double nozzles capable of spraying under medium and low pressure, comprising a secondary nozzle, a sprinkler body, a fluidic element body comprising an active region, a cover plate, a water-intake signal nozzle, a bolt, a joint, a screw, a conduit and a water-entry collecting tubule; wherein said fluidic sprinkler comprises a first flow direction of the fluidic element body from the sprinkler body towards the active region of the fluidic element body, and a second flow direction from the water-intake signal nozzle to the water-entry collecting tubule; and wherein a first and second outlet are formed on the sprinkler body in a Y shape, the first outlet of the sprinkler body is in threaded connection with the secondary nozzle, and the second outlet is in threaded connection with the fluidic element body; the cover plate is fixedly installed at an end of the fluidic element body, and an inner diameter of the cover plate is greater than an outer diameter of the fluidic element body; an installing hole is formed on one side of the cover plate, and a central axis of the installing hole is parallel to the first flow direction through the fluidic element body; a circular through hole and a threaded through hole are formed on the joint, wherein the threaded through hole comprises a central axis and the circular through hole comprises a central axis and an inner diameter, and wherein the central axis of the threaded through hole intersects and is perpendicular to the central axis of the circular through hole; an inner diameter of the circular through hole is greater than an outer diameter of the water-intake signal nozzle; a first end of the screw is in threaded connection with the installing hole, and a second end of the screw is in threaded connection with the threaded through hole of the joint; an axial setting position of the water-intake signal nozzle is fixed through the screw; the water-intake signal nozzle passes through the circular through hole of the joint; the bolt is in threaded fitting with the threaded through hole on the joint; a radial setting position of the water-intake signal nozzle is fixed through the bolt, such that the water-intake signal nozzle is fixedly located above the outlet of the cover plate; and the water-intake signal nozzle is connected with the water-entry collecting tubule on the sidewall of the fluidic element body through the conduit.

2. The fluidic sprinkler with double nozzles capable of spraying under medium and low pressure according to claim 1, wherein an elevation angle of the second outlet of the sprinkler body comprises a fluidic element body elevation angle and an elevation angle of the first outlet of the sprinkler body comprises a secondary nozzle elevation angle, and the fluidic element body elevation angle is 1 to 1.5 times the secondary nozzle elevation angle.

3. The fluidic sprinkler with double nozzles capable of spraying under medium and low pressure according to claim 1, wherein the secondary nozzle comprises a secondary locknut which adjusts the setting position of the outlet of the secondary nozzle such that the secondary nozzle supplements water distribution of the medium and low-pressure sprinkling fluidic sprinkler.

4. The fluidic sprinkler with double nozzles capable of spraying under medium and low pressure according to claim 1, wherein the fluidic element body comprises a primary locknut which adjusts the setting position of the fluidic element body such that the fluidic element body obtains a driving force to drive the medium and low-pressure sprinkling fluidic sprinkler to accomplish rotation.

5. The fluidic sprinkler with double nozzles capable of spraying under medium and low pressure according to claim 1, wherein a middle locknut and a lower locknut are arranged on the screw on two sides of the cover plate, respectively.

6. The fluidic sprinkler with double nozzles capable of spraying under medium and low pressure according to claim 1, further comprising a basic circular hole in the fluidic element body, wherein the outlet diameter of the cover plate is 1.2 to 1.8 times the diameter of the basic circular hole.

7. The fluidic sprinkler with double nozzles capable of spraying under medium and low pressure according to claim 1, wherein an upper locknut is arranged on the screw at the threaded through hole of the joint for fixing the connection position between the screw and the joint.

8. The fluidic sprinkler with double nozzles capable of spraying under medium and low pressure according to claim 1, wherein a water intake of the water-intake signal nozzle is in a chamfer shape, wherein the chamfer shape is formed by an included angle of less than 90° between an end face of the water-intake signal nozzle and a radial axis of the water-intake signal nozzle, wherein said radial axis is parallel to the second flow direction; and wherein the second flow direction from the water-intake signal nozzle and a third flow direction from the air supply hole to the active region of the fluidic element body are perpendicular to the first flow direction of the fluidic element body.

* * * * *